United States Patent [19]

Long et al.

[11] Patent Number: 4,466,163

[45] Date of Patent: Aug. 21, 1984

[54] WIDE FABRIC MANUFACTURING METHOD AND APPARATUS

[76] Inventors: Barry W. Long, 4458 Conestoga Trail, Copley, Ohio 44321; David H. Roush, deceased, late of Plain Township, Stark County, Ohio; by Vivian J. Roush, heir, 1818 Broad Ave. NW., Canton, Ohio 44708

[21] Appl. No.: 262,196

[22] Filed: May 11, 1981

[51] Int. Cl.[3] ..... D06H 7/00; D03D 41/00

[52] U.S. Cl. ..... 28/170; 28/190; 28/218; 139/11

[58] Field of Search ..... 28/170, 166, 180, 190, 28/218; 139/11 R, 426 TW

[56] References Cited

U.S. PATENT DOCUMENTS

| | | | |
|---|---|---|---|
| 811,358 | 1/1906 | Baer . | |
| 1,267,025 | 5/1918 | Weinheim | 28/166 X |
| 1,822,889 | 9/1931 | Helwith | 139/426 TW |
| 2,596,246 | 5/1952 | Johnson et al. | 28/166 X |
| 3,336,645 | 8/1967 | Mirsky | 139/11 X |
| 3,626,989 | 12/1971 | Held | 139/11 |
| 3,789,469 | 2/1974 | Kodama . | |
| 4,080,694 | 3/1978 | Moore et al. | 28/170 |
| 4,118,842 | 10/1978 | Norris et al. . | |
| 4,137,614 | 2/1979 | Wolstencroft | 28/170 X |

*Primary Examiner*—James Kee Chi

[57] ABSTRACT

Wide woven fabric having dipped and treated cords is made by first connecting warp cords of relatively strong material in at least two narrow sheets. The narrow sheets are dipped and treated after which they are positioned in loom letoff rolls adjacent a loom where they are joined to form a wide fabric having a width greater than the width of either of the narrow sheets. The warp cords from the narrow sheets are guided from the letoff rolls into the loom and during the process the narrow sheets may be run through a cord separating apparatus to separate the warp cords. The warp cords may be woven in the loom with a dipped and treated weft cord to provide a wide reinforcing sheet with a heavy woven construction having a width greater than the width of any one of the narrow sheets.

14 Claims, 5 Drawing Figures

WIDE FABRIC MANUFACTURING METHOD AND APPARATUS

This invention relates generally to the manufacture of reinforcing fabric for rubber articles such as conveyor belts and especially to the manufacture of wide woven fabrics from dipped and treated cords.

The apparatus used at the present time for dipping and treating reinforcing fabric is costly because after the fabric is woven and dipped it is passed through a large chamber in which the fabric is subjected to controlled tension at controlled temperatures for a substantial period of time. A number of these treating units are in operation for narrow sheets of fabric used to reinforce tires; however, there are very few treating units for wide fabric because of the high cost of the wider units. On the other hand, there is a need for the wider fabrics used in making conveyor belts of a substantial width.

It has been proposed to weave narrow sheets of fabric with warp cords connected by pick cords and after this fabric is dipped and treated, cut the pick cords and wind the warp cords on individual spools for weaving into a new wider reinforcing sheet of fabric. This requires the storage and handling of the spools of warp cords which must then be set up for weaving wide fabric in another loom.

The present invention is directed to a system of manufacturing wide fabric in which it is not necessary to wind the warp cords on individual spools for weaving into a new wider sheet of fabric. In accordance with this invention, the warp cords of narrow sheets of treated fabric may be suitably processed and then joined into a wide fabric having the required strength for reinforcing belts and other wide rubber products. In this way, the presently available fabric dipping and treating equipment can be utilized and the deweaving and reweaving is performed economically and with a minimum amount of processing of the warp cords coming from the treated narrow sheets of fabric.

In accordance with one aspect of this invention there is provided a method for making wide reinforcing fabric comprising the steps of placing at least a first fabric and a second fabric, treated by dipping in a suitable adhesive and run through a chamber at controlled temperatures and tension for predetermined times, on a letoff adjacent a loom;

pulling the first fabric over a separating means to separate the first warp cords of the first fabric;

pulling the second fabric over a separating means to separate the second warp cords of the second fabric;

guiding the first warp cords and the second warp cords into the loom for joining the first fabric to the second fabric; and weaving by using at least one dipped and treated weft cord with the first and second warp cords to provide a wide sheet of reinforcing fabric having a width greater than the width of the first or second fabrics.

In accordance with another aspect of the invention there is provided apparatus for making a wide reinforcing fabric of treated cords by joining narrow treated fabrics having warp cords comprising a loom, a letoff for at least two of the narrow treated fabrics, separating means disposed between the loom and the letoff for separating the warp cords in the narrow treated fabrics and guide means for directing the warp cords of the narrow treated fabrics from the separating means to the loom for joining the narrow treated fabrics, means to supply a treated weft cord to the loom for weaving between the warp cords of the narrow treated fabrics to make the wide reinforcing fabric of treated cords having a width greater than the width of either of the narrow treated fabrics.

To the accomplishment of the foregoing and related ends, the invention, then, comprises the features hereinafter fully described and particularly pointed out in the claims, the following description and the annexed drawings setting forth in detail certain illustrative embodiments of the invention, these being indicative, however, of but two of the various ways in which the principles of the invention may be employed.

Figure 1:
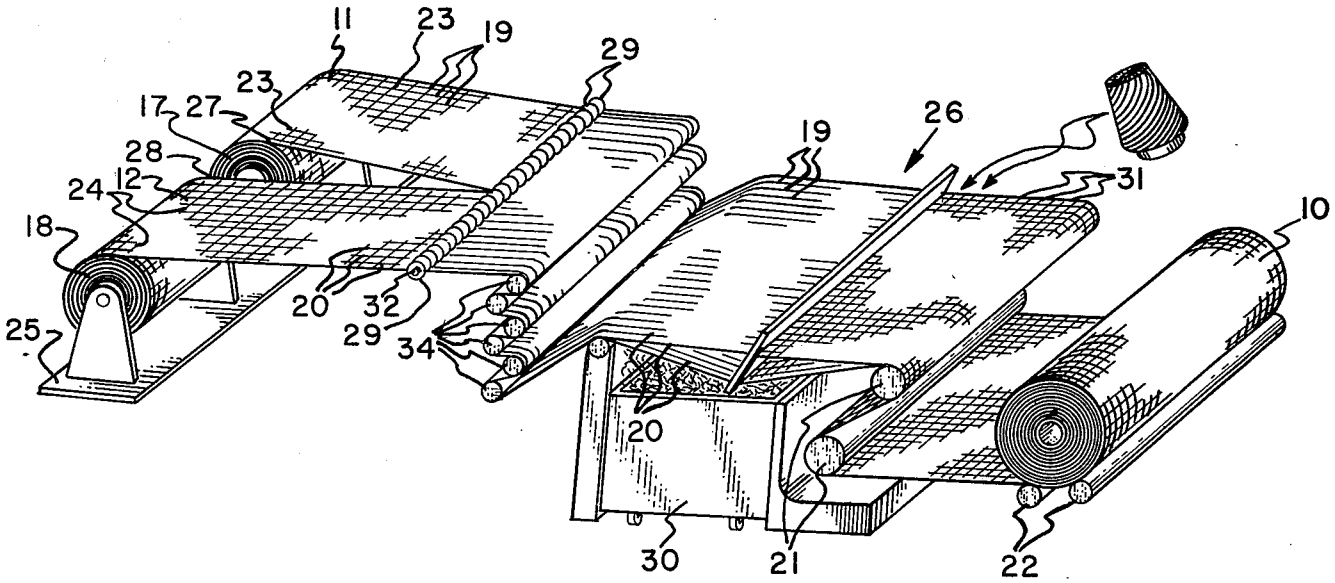
FIG. 1 is a schematic view in perspective of a letoff, separating means and loom embodying the invention.

Referring to FIG. 1, apparatus is shown for making the wide reinforcing fabric 10 by the method of this invention. This wide reinforcing fabric 10 is made from a first narrow fabric 11 and a second narrow fabric 12 which have been dipped in a suitable adhesive such as resorcinol formaldehyde latex and then heat-set at a controlled temperature under a predetermined tension in a suitable treating unit for a predetermined time interval. The untreated narrow fabric such as first narrow fabric 11 is advanced from a supply roll through a bath of treating solution. Then the fabric 11 is guided by guiding rollers through a heated chamber or oven after which it is wound in a first roll 17. The second narrow fabric 12 may be treated likewise and wound in a second roll 18.

As shown in FIG. 1, each of the rolls 17 and 18 of the first and second narrow fabrics 11 and 12 preferably have high modulus warp cords 19 and 20, respectively, which may be of nylon, polyester, rayon, or aramid suitable for the reinforcement of belts or other fabric-reinforced articles. The warp cords 19 and 20 may be connected by suitable means such as a backing material, an adhesive or as in this embodiment by first pick cords 23 and second pick cords 24 which may be of low modulus nylon, cotton or other suitable material.

After the first warp cords 19 connected by the first pick cords 23 are treated, the roll 17 is mounted on a dual letoff 25 as shown in FIG. 1. The second roll 18 containing the treated second warp cords 20 connected by the second pick cords 24 is also mounted on the letoff 25 in end-to-end relationship in an axial direction with the first roll 17. The first narrow fabric 11 from the first roll 17 is fed into a loom 26 at one side of the loom and the second narrow fabric 12 from the second roll 18 is fed into the loom at an opposite side with an edge cord 27 of the first narrow fabric adjacent an edge cord 28 of the second narrow fabric. The wide reinforcing fabric 10 has a width which is greater than the width of either the first narrow fabric 11 or the second narrow fabric 12. In this embodiment the first narrow fabric 11 has a width of about 55 inches (14.0 cm). The second narrow fabric 12 also has a width of about 55 inches (14.0 cm) and the wide reinforcing fabric 10 has a width of about 76 inches (19.3 cm). The first and second narrow fabrics 11 and 12 have cords 19 and 20 spaced apart at around 25 ends per inch (10 ends per cm) and therefore the wide reinforcing fabric has cords spaced at around 36 ends per inch (14 ends per cm). It is understood that the spacing of the cords 19 and 20 and the widths of the first and second narrow fabrics 11 and 12 as well as the width of the wide reinforcing fabric 10 may be varied to provide the width and ends per inch spacing required for a particular application.

Prior to entering the loom 26 the first and second narrow fabrics 11 and 12 are pulled through suitable warp cord separating means such as cutting means having circular knives 29 mounted in side-by-side relationship at spaced-apart positions transversely of the fabrics to cut the pick cords 23 and 24 from the warp cords 19 and 20. A box 30 may be positioned below the warp cords 19 and 20 to catch the picks cut from the fabrics 11 and 12 as they are shaken in the loom 26. The circular knives 29 in addition to cutting the pick cords 23 and 24 may also guide the warp cords 19 and 20.

Figure 5:
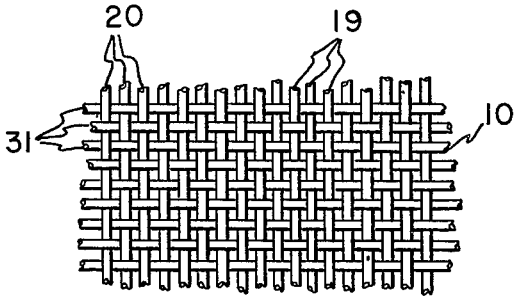
FIG. 5 is an enlarged view showing the heavy woven construction of the wide woven fabric.

In the loom 26 the first and second narrow fabrics are joined together with the warp cords 19 and 20 being woven together by a weft cord 31 into a heavy woven wide reinforcing fabric 10, shown in an enlarged view in FIG. 5. The weft cord 31 may be a dipped and treated cord of high modulus material such as nylon, polyester, rayon or aramid. With the side-by-side relationship of the first and second narrow fabrics 11 and 12 the warp cords 19 and 20 are generally in alignment with the loom 26 and the amount of guidance required of the circular knives 29 is minimal.

Figure 3:
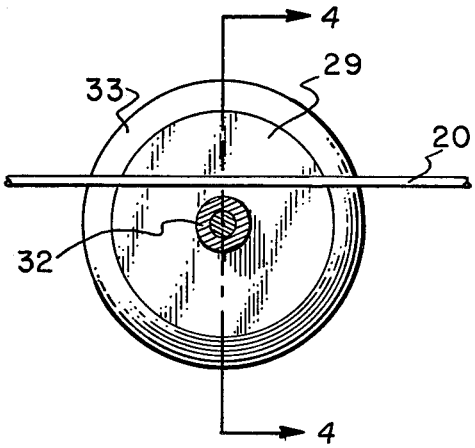
FIG. 3 is an enlarged sectional end view of a cutting knife and bushing taken along line 3—3 of FIG. 4.
Figure 4:
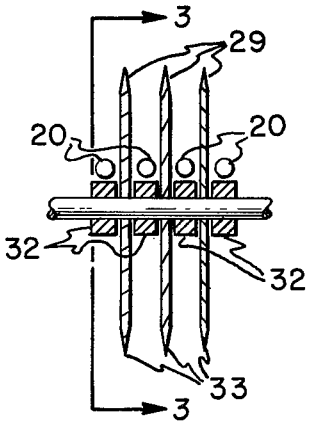
FIG. 4 is a fragmentary longitudinal sectional view of the knives taken along line 4—4 in FIG. 3.

As shown in FIGS. 3 and 4, the circular knives 29 are mounted for rotation on a shaft and separated by rotatable bushings 32. With this construction, circular knife edges 33 engage the pick cords 23 and 24 while the knife surfaces separate the warp cords 19 and 20 without damage to the warp cords. With one fabric of a preferred embodiment (not shown), it has been found that it was satisfactory to space the knives 29 at intervals of around one-half inch (1.3 cm) across the fabric width.

Between the loom 26 and the circular knives 29 a hold-back means such as crimp bars 34 may be positioned to develop the desired tension of the warp cords 19 and 20 in the loom. The warp cords 19 and 20 are wrapped around the crimp bars 34 which may be adjustable to increase or decrease the distance between the bars and thereby increase or decrease the angle of wrap around the bars.

Driven loom rolls 21 may be connected to a motor (not shown) to tension the warp cords 19 and 20 in the loom 26. Also surface driven windup rolls 22 may be provided in engagement with the surface of the finished roll of wide fabric 10. These windup rolls 22 may also be connected to a motor (not shown). With the crimp bars 34 and the driven rolls 21 and windup rolls 22 the desired relatively high tension of the warp cords 19 and 20 in the loom 26 is obtainable.

The desired tension in the first narrow fabric 11 and second narrow fabric 12 as well as tension in the first warp cords 19 and second warp cords 20 is obtained by brakes (not shown) in the letoff 25 restraining rotation of the first roll 17 and second roll 18. The tension between the letoff 25 and the crimp bars 34 may be less than the tension in the loom 26.

Figure 2:
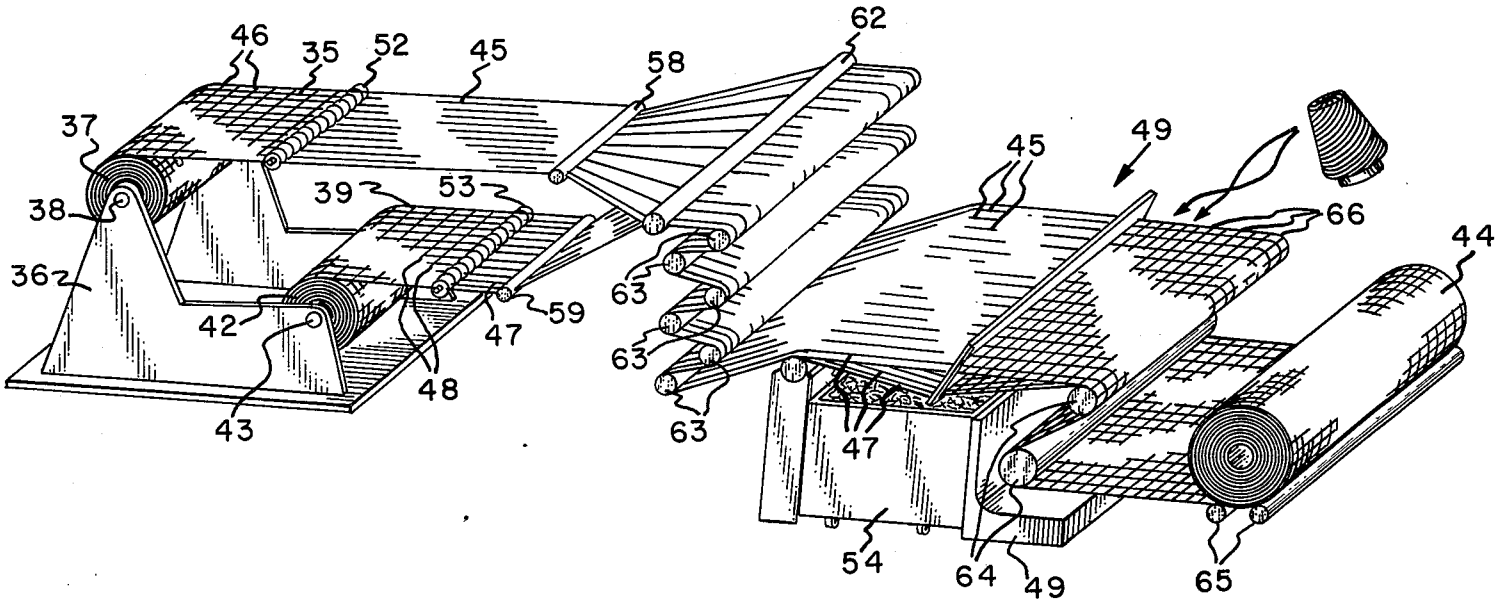
FIG. 2 is a schematic view in perspective of another letoff, separating means, guiding combs, and a loom embodying the invention.

Referring to FIG. 2, a modification is shown in which a first narrow fabric 35 having a construction similar to the first narrow fabric 11 of the embodiment of FIGS. 1 and 3 is shown on a letoff 36. The first narrow fabric 35 is wound in a treated first roll 37 mounted on a rotatable support 38 of the letoff 36. A second narrow fabric 39 having a construction similar to the second narrow fabric 12 of the embodiment of FIG. 1 is wound in a treated second roll 42 mounted on a rotatable support 43 which is generally spaced apart from the first rotatable support 38 in a vertical direction.

The first narrow fabric 35 and second narrow fabric 39 are processed to produce a wide reinforcing fabric 44 which has a width greater than the width of either of the narrow fabrics. In this embodiment, the width of the first narrow fabric 35 is around 55 inches (14.0 cm) and the width of the second narrow fabric 39 is also around 55 inches. The width of the wide reinforcing fabric 44 is about 76 inches (19.3 cm).

The first narrow fabric 35 has first high modulus warp cords 45 which may be connected by suitable means such as first pick cords 46. The high modulus warp cords 45 may be twisted in an "S" direction.

The second narrow fabric 39 has second high modulus warp cords 47 which may be connected by suitable means such as second pick cords 48. The second high modulus warp cords 47 may be twisted in the "Z" direction which is opposite to the direction of twist of the first high modulus warp cords 45.

The first and second narrow fabrics 35 and 39 have warp cords 45 and 47 spaced apart at around 25 ends per inch (10 ends per cm) and therefore the wide reinforcing fabric 44 has cords spaced at around 36 ends per inch (14 ends per cm). It is understood that the spacing of the cords 45 and 47 and the widths of the first and second narrow fabrics 35 and 39 as well as the width of the wide reinforcing fabric 44 may be varied to provide the width and ends per inch spacing required for a particular application.

A loom 49 is provided for joining the first and second narrow fabrics 35 and 39 by weaving the first high modulus warp cords 45 and second high modulus warp cords 47 together. The pick cords 46 and 48 are cut away from the warp cords 45 and 47 by separating means such as upper cutting means having circular knives 52 and lower cutting means having circular knives 53 positioned between the upper first roll 37 and the loom 49 and between the lower second roll 42 and the loom, respectively. The circular knives 52 and 53 may have the same construction as the circular knives 29 of the embodiment illustrated in FIGS. 1, 3 and 4. A box 54 may be positioned below the warp cords 45 and 47 to catch the picks cut from the fabrics 35 and 39 as they are shaken in the loom.

The first high modulus warp cords 45 are guided through an upper comb 58 which has a width substantially the same as the width of the first narrow fabric 35. The second high modulus warp cords 47 are guided through a lower comb 59 which has a width substantially the same as the width of the second narrow fabric 39. The first high modulus warp cords 45 and second high modulus warp cords 47 are guided from the upper comb 58 and lower comb 59 to a wide comb 62 which has a width greater than the width of the upper comb or lower comb. In the wide comb 62 the first high modulus warp cords 45 are positioned between the second high modulus warp cords 47 so that the alternate cords may have a different twist, S and Z, across the wide reinforcing fabric 44.

Between the wide comb 62 and the loom 49 a hold-back means such as crimp bars 63 may be positioned to develop the desired tension of the warp cords 45 and 47 in the loom. The warp cords 45 and 47 are wrapped around the crimp bars 63 which may be adjustable to increase or decrease the distance between the bars and thereby increase or decrease the angle of wrap around the bars.

The loom 49 has driven loom rolls 64 for tensioning the warp cords 45 and 47 and are similar to the rolls 21 of loom 26 shown in FIG. 1. Likewise windup rolls 65 engage the roll of finished wide fabric 44 similar to the rolls 22 of the loom 26 of FIG. 1. Furthermore the rotation of the first roll 37 and second roll 42 is restrained by brakes on the letoff 36 similar to the brakes on the letoff 25 shown in FIG. 1 and described hereinabove.

To weave the wide reinforcing fabric 44 a weft cord 66 which may be a dipped and treated cord of high modulus material such as nylon, rayon, polyester or aramid is woven between the first high modulus warp cords 45 and second high modulus warp cords 47 to provide a substantially tight heavy woven fabric which may be used for reinforcing belts or other reinforced rubber or plastic articles. This wide reinforcing fabric 44 is similar to the wide reinforcing fabric 10 illustrated in FIG. 5.

While certain representative embodiments and details have been shown for the purpose of illustrating the invention, it will be apparent to those skilled in the art that various other changes and modifications may be made therein without departing from the scope of the invention.

We claim:

1. A method for making wide reinforcing fabric having warp cords spaced apart at a predetermined number of ends per inch comprising the steps of placing at least a first fabric having first warp cords spaced apart at a first number of ends per inch and connected by first pick cords and a second fabric having second wrap cords spaced apart at a second number of ends per inch and connected by second pick cords on a letoff adjacent a loom, said first fabric and said second fabric being treated by dipping in a suitable adhesive and run through a chamber at controlled temperatures and tension for a predetermined time;

pulling said first fabric over a separating means to separate said first warp cords of said first fabric by cutting said first pick cords;

pulling said second fabric over a separating means to separate said second warp cords of said second fabric by cutting said second pick cords;

guiding said first warp cords and said second warp cords into said loom for joining the first fabric to the second fabric; and weaving by using at least one dipped and treated weft cord with said first and second warp cords to provide a wide sheet of reinforcing fabric having a predetermined width greater than the width of said first or second fabrics and warp cords spaced apart at said predetermined number of ends per inch.

2. The method according to claim 1 wherein said first fabric is in a first roll and said second fabric is in a second roll, said first roll and said second roll being positioned in said letoff and said first fabric and said second fabric being pulled from said first and second rolls over said separating means.

3. The method according to claim 2 wherein said first roll and said second roll are positioned generally end-to-end in an axial direction and said first fabric is guided into said loom at one side and said second fabric is guided into said loom at an opposite side with an edge cord of said first fabric being adjacent an edge cord of said second fabric.

4. The method according to claim 1 including the step of holding back said warp cords between said separating means and said loom to provide tension of said cords in the loom.

5. The method according to claim 2 wherein pulling said fabric from said first and second rolls over said separating means also includes guiding said warp cords into said loom.

6. The method according to claim 2 wherein said first roll and said second roll are positioned one over the other and said first and second warp cords are guided into said loom so that said wide sheet of reinforcing fabric has alternate first and second warp cords across the width of said wide sheet.

7. The method according to claim 6 wherein said first warp cords are twisted in one direction and said second warp cords are twisted in an opposite direction.

8. The method according to claim 1 wherein said first fabric and said second fabric are heavy woven.

9. The method according to claim 1 wherein said wide sheet of reinforcing fabric is heavy woven during said weaving of said weft cord with said first and second warp cords.

10. The method according to claim 1 wherein said first warp cords and said second warp cords have a high modulus.

11. The method according to claim 1 wherein said first pick cords and said second pick cords of said first fabric and said second fabric have a low modulus.

12. The method according to claim 1 wherein said dipped and treated weft cord woven with said first and second warp cords has a high modulus.

13. The method according to claim 1 wherein said predetermined number of ends per inch of said wide sheet of reinforcing fabric is greater than said first number of ends per inch or said second number of ends per inch of said first fabric and said second fabric.

14. The method according to claim 13 wherein said first number of ends per inch and said second number of ends per inch are equal.

* * * * *

UNITED STATES PATENT OFFICE

CERTIFICATE OF CORRECTION

Patent No. 4,466,163 Dated August 21, 1984

Inventor(s) Barry W. Long et al

It is certified that error appears in the above-identified patent and that said Letters Patent are hereby corrected as shown below:

Cover page should include:

--[73] Assignee: The Goodyear Tire & Rubber Company, Akron, Ohio

Signed and Sealed this

*Nineteenth* Day of *March 1985*

[SEAL]

*Attest:*

DONALD J. QUIGG

*Attesting Officer* *Acting Commissioner of Patents and Trademarks*